US010415204B1

(12) United States Patent
Beebe

(10) Patent No.: US 10,415,204 B1
(45) Date of Patent: Sep. 17, 2019

(54) MULTI-ENVIRONMENT SELF-ELEVATING DRILLING PLATFORM

(71) Applicant: Northern Offshore Ltd., Houston, TX (US)

(72) Inventor: Anthony James Beebe, West University Place, TX (US)

(73) Assignee: NORTHERN OFFSHORE LTD., Hamilton (BM)

( * ) Notice: Subject to any disclaimer, the term of this patent is extended or adjusted under 35 U.S.C. 154(b) by 0 days.

(21) Appl. No.: 15/967,103

(22) Filed: Apr. 30, 2018

(51) Int. Cl.

| | |
|---|---|
| ***E02B 17/04*** | (2006.01) |
| ***E02B 17/02*** | (2006.01) |
| ***E02B 17/08*** | (2006.01) |
| ***E21B 15/02*** | (2006.01) |
| ***E02B 17/00*** | (2006.01) |
| ***E21B 41/08*** | (2006.01) |

(52) U.S. Cl.
CPC ..... *E02B 17/08* (2013.01); *E02B 17/0004* (2013.01); *E21B 15/02* (2013.01); *E21B 41/08* (2013.01); *E02B 2017/0056* (2013.01)

(58) Field of Classification Search
CPC ..... B63B 43/06; E02B 17/02; E02B 17/021; E02B 17/04; E02B 2017/0039; E02B 2017/0043; E02B 2017/0056; E02B 2017/006; E02B 2017/0073; E02B 2017/0082
USPC ..... 405/196, 197, 198, 203, 205, 206, 207, 405/208
See application file for complete search history.

(56) References Cited

U.S. PATENT DOCUMENTS 3,064,437 A * 11/1962 Knapp ..... E02B 17/027 114/123
3,138,932 A * 6/1964 Kofahl ..... E02B 17/021 405/209
3,466,878 A * 9/1969 Esquillan ..... E02B 17/021 405/203
3,797,256 A * 3/1974 Giblon ..... B63B 35/4413 405/196
3,934,528 A * 1/1976 Horton ..... B63B 21/502 114/296
4,065,934 A * 1/1978 Dysarz ..... E02B 17/021 114/258
4,224,005 A * 9/1980 Dysarz ..... E02B 17/021 405/196

(Continued)

*Primary Examiner* — Benjamin F Fiorello
*Assistant Examiner* — Edwin J Toledo-Duran
(74) *Attorney, Agent, or Firm* — Nolte Intellectual Property Law Group

(57) ABSTRACT

According to certain embodiments, a method is performed using a self-elevating vessel having at least one preload tank and a plurality of movable support legs each with a spudcan affixed at the base. The method comprises locating the self-elevating vessel at a first ocean environment, lowering the legs to a surface of a seafloor with a first bearing pressure requirement, and filling the at least one preload tank to a first volume that is sufficient to drive the footings into the seafloor. The first volume is different than a second volume that is a volume sufficient to drive the footings into a seafloor of a second ocean environment that has a different bearing pressure requirement than the seafloor of the first ocean environment. The preload tank is sized to have a volume capacity based on the greater bearing pressure requirement between the first and the second ocean environment.

7 Claims, 4 Drawing Sheets

(56) References Cited

U.S. PATENT DOCUMENTS 4,232,983 A * 11/1980 Cook ..... B63B 25/08 114/257
4,365,576 A * 12/1982 Cook ..... B63B 35/44 114/257
4,456,404 A * 6/1984 Evans ..... E02B 17/021 405/195.1
4,482,274 A * 11/1984 Brandi ..... B63B 21/502 114/265
4,604,001 A * 8/1986 Wetmore ..... B63B 21/502 114/265
4,695,201 A * 9/1987 Beskow ..... E02B 17/00 114/296
4,902,169 A * 2/1990 Sutton ..... E02B 17/021 405/196
4,916,999 A * 4/1990 Palmer ..... F41F 3/04 89/1.8
5,188,484 A * 2/1993 White ..... E02B 17/021 405/198
5,704,731 A * 1/1998 Huang ..... B63B 3/04 114/264
6,347,912 B1 * 2/2002 Thomas ..... E21B 19/006 405/224.2
6,378,451 B1 * 4/2002 Wetch ..... B63B 13/00 114/125
6,564,741 B2 * 5/2003 Nelson ..... B63B 35/4406 114/264
6,830,413 B2 * 12/2004 Wybro ..... B63B 13/00 114/125
7,008,140 B2 * 3/2006 Copple ..... B63B 21/502 114/265
7,152,544 B2 * 12/2006 Kryska ..... B63B 13/00 114/125
7,886,845 B2 * 2/2011 King ..... E21B 44/00 175/40
8,070,388 B2 * 12/2011 Thomas ..... B63B 35/003 405/196
2006/0051164 A1 * 3/2006 Foo ..... E02B 17/0021 405/228
2008/0289876 A1 * 11/2008 King ..... E21B 44/00 175/40
2009/0208294 A1 * 8/2009 Yao ..... E02B 17/021 405/196
2009/0304452 A1 * 12/2009 Bernadac ..... E02B 3/064 405/196
2010/0150660 A1 * 6/2010 Nadarajah ..... E02B 17/00 405/196
2011/0211915 A1 * 9/2011 Van Nood ..... E02B 17/0809 405/197
2013/0189038 A1 * 7/2013 Lenders ..... B63B 35/4413 405/196

* cited by examiner

MULTI-ENVIRONMENT SELF-ELEVATING DRILLING PLATFORM

TECHNICAL FIELD

The invention relates generally to a self-elevating vessel that may be used in a variety of oceanic environments having different environmental characteristics, including different seafloor bearing pressure requirements.

BACKGROUND

Self-elevating vessels, more commonly referred to as jackup vessels, have a hull that may be raised to a certain elevation above the surface of the sea by a set of support legs embedded in the seafloor atop specialized footings. Conventional jackup vessels are designed for the particular environmental characteristics of the region in which they perform their operations. These operations may include drilling for oil and gas, well workover or stimulation, plug and abandonment of wells, support, windmill installation and platform construction, as well as removal and maintenance of windmills. Conventional jackup rigs are suitable for operation only in a particular ocean environment and otherwise require substantial modification before being relocated for use in another region.

SUMMARY OF THE DISCLOSURE

According to certain embodiments, a method is performed using a self-elevating vessel having at least one preload tank and a plurality of movable support legs each with a footing affixed at the base of the leg. The method comprises locating the self-elevating vessel at a location of a first ocean environment, lowering the legs to a surface of a seafloor of the first ocean environment with a first bearing pressure requirement, and filling the at least one preload tank to a first volume that is sufficient to drive the footings into the seafloor. The first volume is different than a second volume that is a volume sufficient to drive the footings into a seafloor of a second ocean environment that has a different bearing pressure requirement than the seafloor of the first ocean environment. The preload tank is sized to have a volume capacity based on the greater bearing pressure requirement between the first and the second ocean environment.

According to certain embodiments, a self-elevating vessel comprises at least one preload tank and a plurality of movable support, legs. Each leg has a footing affixed to the base of the plurality of legs. The at least one preload tank is filled to a first volume sufficient to drive the footings into a seafloor of a first ocean environment that has a first bearing pressure requirement. The first volume is different than a second volume that is sufficient to drive the footings into a seafloor of a second ocean environment with a second bearing pressure requirement. The second bearing pressure requirement is different than the first bearing pressure requirement and the at least one preload tank is sized to have a volume capacity based on the greater of the first bearing pressure requirement and the second bearing pressure requirement.

According to certain embodiments, a method of driving a footing affixed to a support leg of a self-elevating vessel with at least one preload tank into a seafloor of an ocean environment with a bearing pressure requirement comprises lowering the support leg so that the footing is in contact with the seafloor. The method further comprises filling the at least one preload tank to a volume that is sufficient to drive the footing into the seafloor but that is not more than 70% of the volume capacity of the at least one preload tank.

According to certain embodiments, a self-elevating vessel includes a platform, at least one preload tank, and a plurality of movable support legs. Each leg has a footing affixed to the base of the plurality of legs. The self-elevating vessel is classified for operations in a first ocean environment and is also classified for operations in a second ocean environment where the second ocean environment has a different bearing pressure requirement than the first ocean environment.

Certain embodiments may provide one or more technical advantages. As an example, certain embodiments provide advantages for enabling the use of a self-elevating vessel in a variety of different oceanic regions. As another example, certain embodiments provide the advantage of eliminating the need to modify the footings at the base of the support legs of a self-elevating vessel. As a result of eliminating this modification requirement the cost of operating a mobile self-elevating vessel in multiple regions may be greatly reduced. This reduced cost may be two-fold: eliminating the cost associated with performing the modification to the footings and reducing the lost operational time associated with relocating the rig both to a dry dock and then relocating the rig back to the new drilling site in addition to eliminating the time spent completing the modification. Another advantage is that a multi-environment jackup rig may have more than one environmental criteria classification assigned to the rig. Having a classification for two different environmental conditions enables the rig to pre-qualify for operations in regions that fall under different environmental conditions classification without requiring a costly site-specific analysis as compared to a single-environment classified rig, Certain embodiments may include all, some, or none of the above-described advantages. Other advantages will be apparent to those of ordinary skill in the art.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figures 1A, 1B, 1C, 1D, 1E:
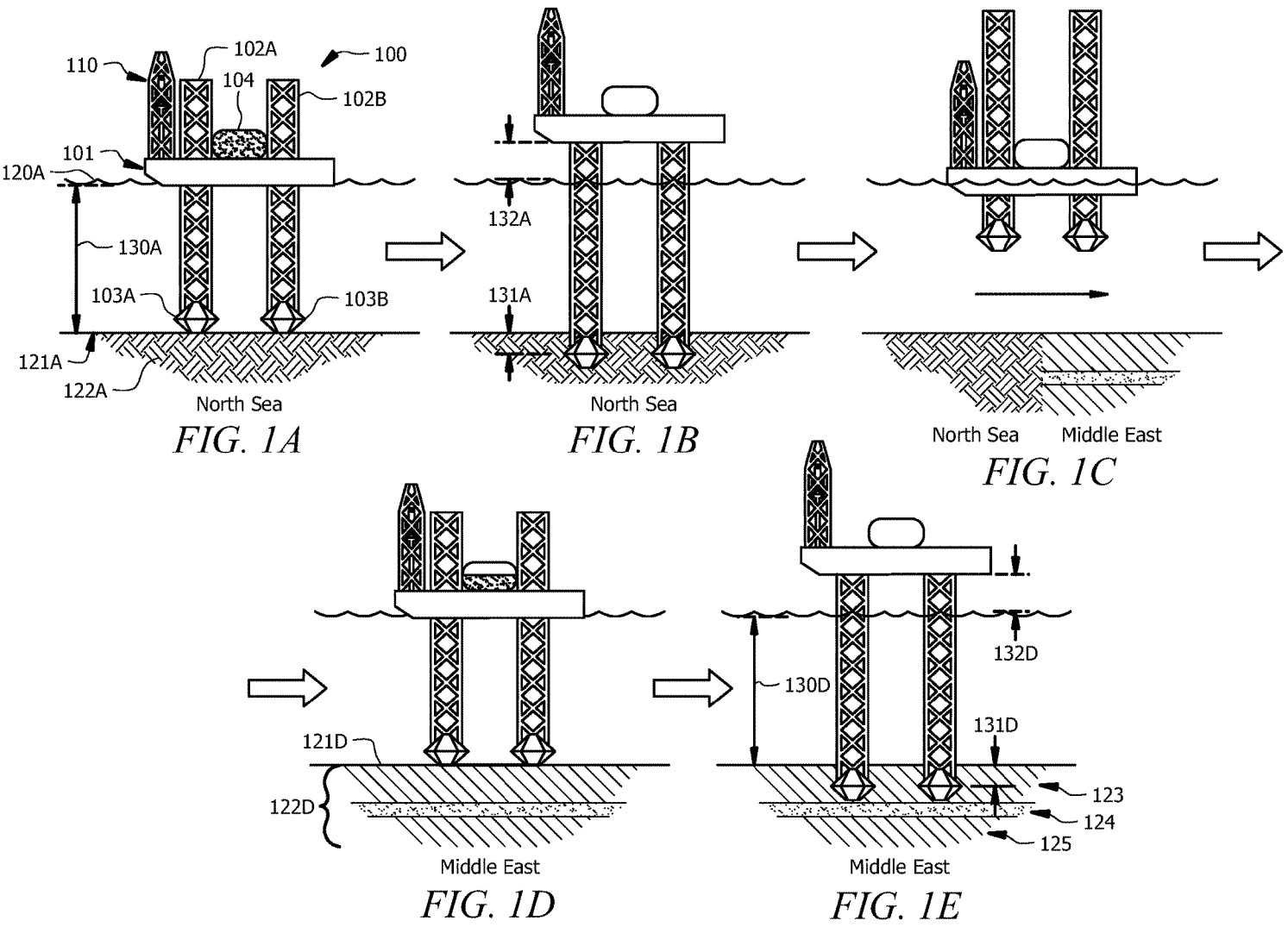
FIGS. 1A through 1E illustrate a series of an example embodiment of a jackup rig being used in a first environment and then subsequently being relocated and used in a second environment.

Self-elevating vessels may include both self-elevating lift boats, that are usually self-propelled ship shaped vessels that form a floating hull, or jackup drilling rigs, that are usually non-self-propelled triangular or other shaped barges that form a floating hull. Each are generally equipped with various specialized equipment onboard. This equipment may allow the self-elevating vessel to perform unique operations that may include functions such as: drilling for oil and gas, well workover or stimulation, plug and abandonment of wells, support, windmill installation and platform construction, removal and maintenance of windmills. The configuration of an example jackup rig will be described in greater detail with respect to FIG. 2. In general, an example triangular shaped jackup rig such as the one in FIG. 2 would have three moveable support legs 102 located at the corners of the rig for stability. Each leg has a footing 103, illustrated as a spudcan having a round structure at the bottom of the leg 102 designed to penetrate into the seabed 122 when the support legs are being set. The footings or spudcan 103 may provide adequate stability against lateral forces from wind and water during drilling or other specialized operations on location. In certain other embodiments, self-elevating vessel 100 may include a mat support as footing 103. The mat-type footing 103 will act as a single footing connected to each support leg 102. The large area of the mat will serve to distribute the weight over a large surface area for operations in ocean environments with low bearing pressure requirements. The mat may be driven into the seabed 122 to a shallow depth 131 to prevent the self-elevating vessel from sliding along the seafloor 121.

When the support legs 102 are raised and retracted from the seafloor (as shown in FIG. 1C) the hull enables the self-elevating vessel or jackup rig 100 to float. In this configuration the jackup rig 100 will act as a barge. The spudcans 103 will be brought up partially or completely into the hull and the support legs 102 will extend above the barge. While afloat, the jackup rig 100 may be relocated. For those rigs that are not self-propelled they will generally be towed and positioned by accompanying tugboats.

When on location, the jackup rig 100 will be positioned, the support legs 102 will be lowered to the seafloor with the spudcans 103 resting on the seafloor 121. The spudcans must be embedded in the seabed 122 to provide adequate stability for the jackup rig 100. This stability must account for the forces related to operational loads and environmental factors. These operational loads include all variable loads, such as equipment weight on the deck, fluids including fuel, water, and drilling mud, drilling loads, and the position of the cantilevered derrick 110, which may skid out from the platform 101 and shift port or starboard. The environmental factors that must be accounted for include water depth, wind, currents, wave height, and wave frequency. In order to properly set the spudcans 103 such that they provide adequate support for the operational requirements of a given region, the legs 102 of the jackup rig 100 must be lowered and locked in place, next the jackup rig 100 must be weighted to provide sufficient force on the spudcans 103 to overcome the resistance of the seafloor 121 and drive the spudcans and support legs into the seabed 122. To accomplish this, a jackup rig may have one or more preload tanks 104 that are filled to capacity. Because of its abundance, seawater may be used when on location to fill the preload tanks 104. The weight of the filled preload tanks 104 increases the total weight of the jackup rig 100 and drives the spudcans 103 into the seabed 122 to secure the rig 100. After the spudcans 103 are sufficiently set, the preload tanks 104 may be emptied and the platform 101 of the jackup rig 100 may be raised, or "jacked up," above the surface 120 of the sea to ensure that there is a sufficient air gap 132 between the platform 101 of the rig 100 and the surface 120 of the ocean. After this, any drilling or other specialized operations may commence.

However, the environmental factors may vary greatly between different locations. For instance, the environmental criteria for the North Sea are very different from those offshore sites in the Middle East. The North Sea has deep water depth, high winds, strong currents, high waive height, and substantial wave frequency requirements. In contrast, most drilling locations in the Middle East have reduced environmental characteristics from those of the North Sea. Unlike the North Sea, some areas of the seabed of the Middle East are composed of more clay and may be softer. As a result, the risk of punch through is greater in the Middle East than it is in the North Sea. A punch through occurs when the weight applied to a spudcan exceeds what the seafloor is capable of supporting and results in one or more legs sinking suddenly in an uncontrolled manner. If one leg drops more rapidly than the other this puts a bending moment on the other legs. A punch through event can lead to equipment damage, damage to the environment, and may pose serious safety risk to anyone on or around the jackup rig.

To reduce this punch through risk, the conventional solution is to modify the spudcans by installing a spudcan ring on each spudcan. These spudcan rings (not explicitly shown) are large steel plates that when installed increase the footing-diameter of the spudcans. This therefore raises the surface area of the spudcan that is in contact with the seafloor. The use of spudcan rings brings with it several shortcomings other than the inherent cost of the modification and the lost operating time. Spudcan rings cause the draft of the jackup rig to be greater when the jackup rig is either being towed or propelling itself en route to location. This is because the spudcan rings will protrude further below the hull of the jackup rig while afloat. This protrusion may also preclude the jackup rig from accessing certain drilling sites that are in more-shallow locations.

To ensure the safe operation of mobile drilling platforms may be given a classification according to the worst-case environmental and operational load the rig can handle. These ratings are controlled by a regulatory body such as the American Bureau of Shipping (ABS). The classification of drilling platform establish the accepted mode of operation for the associated drilling platform. The classification will set forth the bearing pressure of the drilling platform according to that environmental load for which the rating is provided. The mobile drilling platform will be pre-qualified for operations in all ocean environments that meet the classification. A site-specific analysis is required for any operations in ocean environments that have environmental conditions which differ from the drilling platform's environmental rating.

According to the teaching of the disclosure, rather than use spudcan rings to meet the different bearing pressure requirement of the seafloor in different regions, the different environmental requirements may be met by controlling the volume of preload fill used when driving the spudcans into the seabed. Embodiments of the present disclosure and its advantages are best understood by referring to FIGS. 1 through 5 of the drawings, like numerals being used for like and corresponding parts of the various drawings.

FIGS. 1A-1E illustrate a sequence of operations being performed with a self-elevating vessel. For convenience and not by way of limitation, the self-elevating vessel may be referred to as a mobile drilling platform or jackup rig 100. FIGS. 1A-1E depict the jackup rig 100 being located at two different ocean environments with different conditions such as ocean environments that have different bearing pressure requirements. Bearing pressure requirements refers to the capacity of the seafloor and seabed to support a load applied to the ground. The bearing pressure requirement is the maximum average contact pressure between the spudcans 103 and the support legs 102 with the material of the seabed to drive the spudcans into the seabed through shear failure of the seafloor. The bearing pressure will be influenced based on the composition of the seabed (for example, the amounts and ratios of sediment, clay, and soil).

Certain ocean environments may have different bearing pressure requirements because of different compositions of the seabed and the different environmental loads that will be applied to the rig during operation (e.g., from the strength of the current and wave frequency). However, ocean environments may also have a maximum supportable bearing pressure above which a punch through may occur. Because of this a mobile drilling platform may have a classification affirming that it may provide sufficient bearing pressure to embed the support legs and spudcans but not risk causing a punch through. For example, a certification for operations in the North Sea requires a target bearing pressure of 10.96 kips per square foot whereas a certification for operations in the Middle East requires a target bearing pressure of 8.5 kips per square foot (i.e., where 1 kip is equivalent to 1,000 pounds, 10.96 kips/ft$^2$ would be equivalent to 10,960 pounds per square foot). A range within plus or minus ten percent of the target bearing pressure may be acceptable to meet the certification. Although the targets of 10.96 kips per square foot and 8.5 kips per square foot are listed as examples any bearing pressure requirement may be used for a certification (e.g., 20.0 kips/ft$^2$, 18.0 kips/ft$^2$, 16.0 kips/ft$^2$, 14.0 kips/ft$^2$, 12.0 kips/ft$^2$, 11.0 kips/ft$^2$, 10.0 kips/ft$^2$, 9.0 kips/ft$^2$, 8.0 kips/ft$^2$, 6.0 kips/ft$^2$, 4.0 kips/ft$^2$, 2.0 kips/ft$^2$, 0.5 kips/ft$^2$, or intermediates thereof).

As illustrated, the jackup rig 100 is located first at a site in the North Sea and is then relocated for drilling operations at a second site in the Middle East, in this embodiment discussed for illustration purposes, however, any suitable location or specialized operation is contemplated. At both the first location and the second location a series of procedures may be completed to prepare the jackup rig for the drilling operations by first setting the support legs 102A-B and the spudcans 103A-B in the seabed 122. The weight necessary to set the support legs 102A-B is provided by the weight of the rig itself, the dry weight, in combination with the weight of the preload tanks 104. The weight of the preload tanks 104 is substantially greater than the dry weight of the jackup rig 100. Thus, the weight of the filled preload tanks 104 have the most significant contribution to the weight driving the spudcans 103A-B into the seabed 122. In certain embodiments, the dry weight of jackup rig 100 may vary between different drilling sites. For example, the dry weight may differ if the amount of equipment on the deck of platform 101 of jackup rig 100 is different between sites due to different planned operations. Where the dry weight of jackup rig 100 differs from the ordinary amount adjustments to the volume of preload fill may be made (e.g., if the dry weight of the jackup rig 100 has increased by 5,000 pounds due to 5,000 additional pounds of equipment the weight of the preload tanks 104 may be adjusted by filling the preload tanks 104 with 5,000 less pounds of preload fill). In this way the total combined weight of the preload tanks and the dry weight of the jackup rig 100 may be taken into account to provide sufficient bearing pressure for the requirements of the particular ocean environment.

Figure 2:
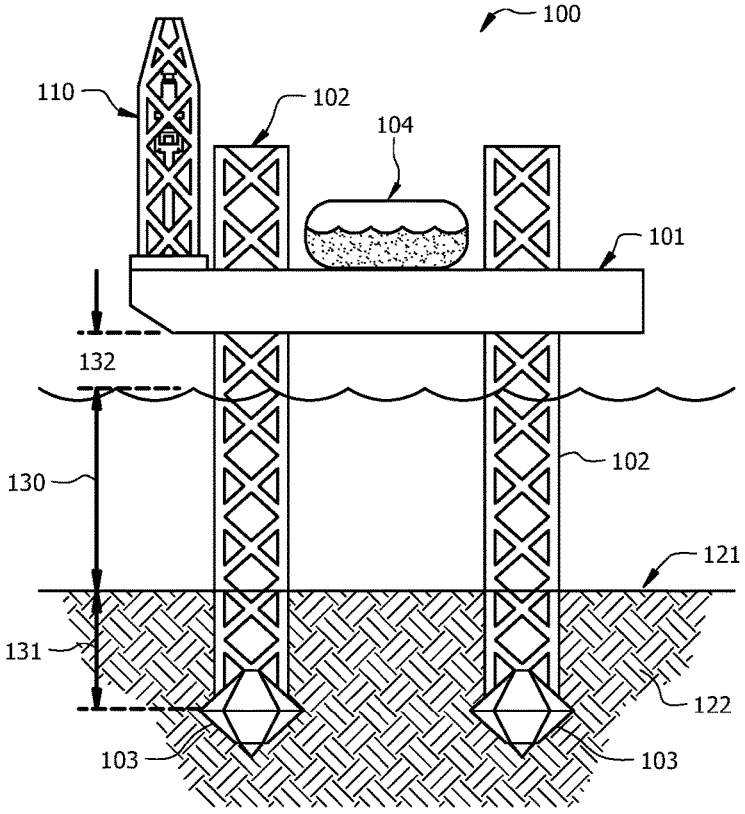
FIG. 2 illustrates an example embodiment of the self-elevating vessel of FIGS. 1A through 1E, showing particular detail of the self-elevating vessel.

In FIG. 1A the jackup rig 100 is already on location. As illustrated, the jackup rig 100 in FIG. 1A is located in the North Sea where the environmental conditions are more-harsh and the seabed 122A is harder. The jackup rig 100 is illustrated as beginning the process of setting the spudcans 103A-B. In this embodiment, the jackup rig 100 may have three support legs 102 and three spudcans 103. The cross-sectional view in FIGS. 1A-2 is used for simplicity and depicts only two of the support legs 102A-B and two of the spudcans 103A-B. For simplicity, the preload tanks have been illustrated as a single preload tank 104 in FIGS. 1-2. The preload tanks 104 are filled to capacity to supply the full amount of weight to drive the spudcans 103A-B through the seafloor 121A and embed the spudcans 103A-B in the seabed 122A. For safety reasons, the hull 101 of the jackup rig 100 may be raised only a few feet at a time with respect to the surface of the sea 120A to mitigate damage from any support leg 102A-B from falling too far in the event of a punch through (e.g., the hull may be raised only five feet out of the water rather than the full elevation as used for the air gap).

FIG. 1B illustrates the jackup rig 100 in its operational configuration. After the spudcans 103A-B were set at an appropriate depth 131A in the seafloor 122A the preload tanks 104 may be emptied of their seawater. Once emptied, the platform 101 may be raised above the sea surface 120A to an appropriate elevation 132A. The elevation of the platform 101 may be related to the environmental conditions of the drill site.

FIG. 1C illustrates the jackup rig 100 after site operations on location have been completed, the platform 101 has been lowered to the sea surface 120, the spudcans 103A-B have been extracted from the seabed 122 and the support legs 102A-B have been raised to their upper most position. The jackup rig 100 is now in its afloat configuration. In this configuration the jackup rig 100 may be relocated to other well sites nearby or may be transported to other ocean regions that may have very different environmental characteristics. As illustrated in FIG. 1C, the jackup rig 100 may be relocated from a more-harsh environment, such as the North Sea, to a less-harsh environment, such as the Middle East (or vice versa).

FIG. 1D illustrates the jackup rig 100 being deployed in a second ocean environment, such as the Middle East in this example. Because the Middle East has very different environmental characteristics from the North Sea the procedure as illustrated and described with respect to FIGS. 1A-1B is not repeated in this second ocean environment. When operating in the Middle East, for example, the seafloor 121D and the seabed 122D may be very different from the seafloor 121A and the seabed 122A of the North Sea. For instance, the seabed 122D in the Middle East has more clay and may have pockets or layers of different densities and different hardnesses as illustrated by the layers 123-125. Because of this, the risk of a punch through event is much more likely in the Middle East.

The conditions in the North Sea have high winds, strong currents, high wave heights, and greater wave frequency requirements. Coupled with this is a larger bearing pressure requirement of approximately 10.96 kips per square foot. To produce the needed bearing pressure the preload tanks 104 have a capacity of one hundred thousand barrels of seawater. The one hundred thousand barrels of seawater provides approximately thirty million pounds of weight to drive the spudcans 103 into the seabed 122A of the North Sea. The preload tanks 104 may be sized to have a maximum capacity that corresponds to the requisite volume of seawater for the most-harsh environment in which the jackup rig 100 will be used (e.g., preload tanks 104 are sized to have full capacity when in use in the North Sea).

The conditions in the Middle East are reduced from those of the North Sea. However, the seafloor 121 cannot support as much weight without the risk of a punch through from the seafloor 121D giving way. Thus, when driving the spudcan 103 into the seabed 122D in the less-harsh ocean environment the preload tanks 104 may be filled to a reduced volume from the full-capacity condition used in the more-harsh ocean environment and as used to size the preload tanks 104. The adjusted fill volume may be described as a ratio of the first volume to the second volume. For example, where the second volume is a volume that fills the preload tank 104 to full capacity and the first volume is a volume less than the second volume the relationship of the first and second volume may be expressed as a ratio. For example, the bearing pressure requirements of the Middle East are 8.5 kips per square foot which would require a preload volume of sixty thousand barrels of water with a resultant jackup rig weight of approximately twenty-four million pounds. In this example the ratio of the second volume to the first volume would be 10:6. The ratio of the first volume to the second volume may be any ratio (e.g., 10:1, 10:2, 10:3, 10:4, 10:5, 10:6, 10:7, 10:8, 10:9, or intermediates thereof). The particular ratio may be adjusted based on the dry weight of the jackup rig 100 (e.g., if the desired ratio is 10:6 and the dry weight of the equipment on the rig between the first and second location increase it may require the ratio of the first and second volume to be adjust to 10:5).

Thus, as illustrated in FIG. 1D, the preload tanks 104 would be filled to a volume of 60% of the volume required for use in a more-harsh environment. Once the preload tanks 104 have been filled to this first volume level the support legs 102 and the spudcans 103 may be driven into the seabed 122D until the appropriate depth 131D has been reached for that ocean environment.

Finally, FIG. 1E illustrates the jackup rig 100 in its operational configuration now in a location with reduced environmental conditions. After the spudcans 103A-B were set at an appropriate depth 131 in the seafloor 122D the preload tanks 104 may be emptied of their sea water. Once emptied, the platform 101 may be raised above the sea surface 120D to an appropriate elevation 132D. The elevation of the platform 101 may again be related to the environmental conditions of the drill site.

Although the scenario of first locating the jackup rig 100 in an a more-harsh ocean environment and then relocating to a less-harsh second ocean environment was given as an example, it should be appreciated that the reverse order or any order is contemplated and adequately described. Thus the jackup rig could relocate instead from a first less-hard ocean environment to a second more-harsh ocean environment. Furthermore, the methods and uses described herein do not require any particular sequence and there may also be intermediate locations before relocating between regions.

The following FIGS. 2-5 will further illustrate the configuration of the mobile drilling platform and the use of such mobile drilling platforms and their associated preload tanks to enable drilling operations to be carried out in multiple environments where the bearing pressure requirements vary substantially between the environments.

Figure 3:
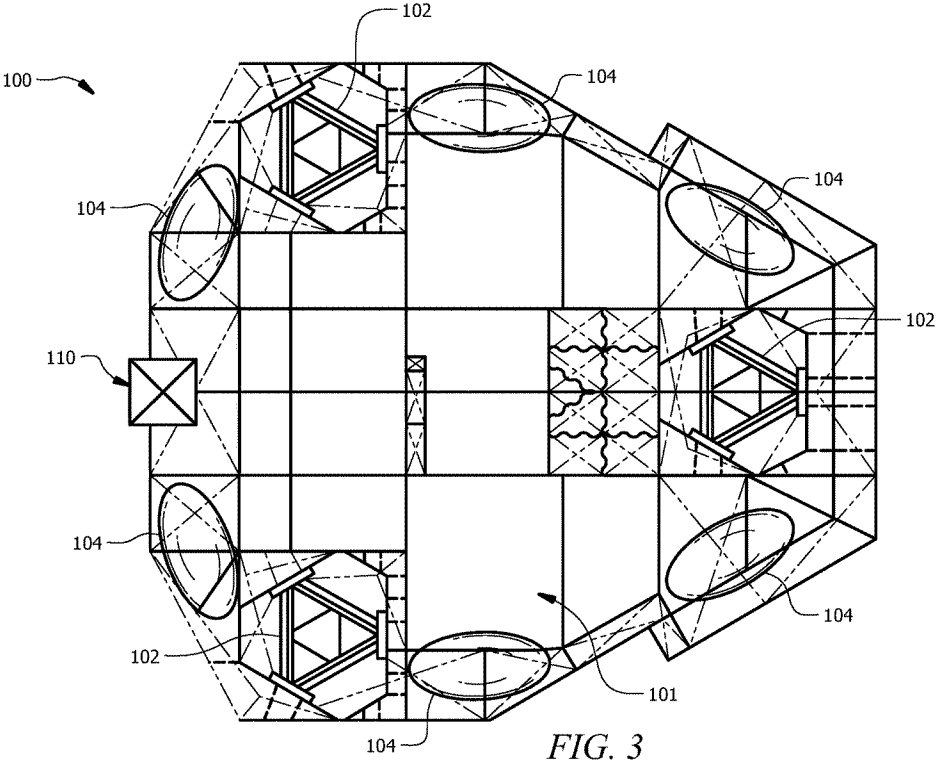
FIG. 3 illustrates the example self-elevating vessel of FIG. 2 from a top-down perspective.

FIGS. 2-3 illustrate the example embodiment of the self-elevating vessel depicted in FIGS. 1A-1E. Again, for convenience and not by way of limitation, the self-elevating vessel may be referred to as a mobile drilling platform or jackup rig 100. As illustrated in FIG. 2, the jackup rig 100 has a platform 101 through which several support legs 102 movably pass. At the base of each of the support legs 102 is a spudcan 103. In certain embodiments the spudcans 103 may be a conically shaped footing with a round base. Furthermore, these spudcans 103 may be sized accordingly to achieve sufficient penetration in a more-harsh ocean environment in a situation where a full volume preload tank 104 is used.

The jackup rig 100 may have a number of tanks 104 that act as a preload tank. When it is desired to secure the support legs in the seafloor the preload tanks 104 may be filled—for example, by pumping in seawater—to increase the weight on the spudcans 103 at the interface of the surface of the spudcans 103 and the seafloor 121 and/or the seabed 122. After the spudcans 103 are set to the desired depth 131 in the seabed 122 the preload tanks 104 may be emptied. The depth 131 depends on the environmental conditions and seabed 122 conditions.

After emptying the preload tanks 104 the platform 101 may be raised, "jacked up," the support legs so that the platform has an airgap 132 between the surface of the ocean and the bottom of the platform 101. This airgap 132 is to ensure that any waves from the surface of the sea 220 do not interfere with operations ongoing on the deck of the platform 101. Once in the elevated position, the jackup rig 100 may cantilever the derrick 110 over the edge of the platform 101 to execute any drilling or other specialized operations.

Once all drilling and site development activities have been completed on location, the platform 101 of the jackup rig 100 may be lowered back to the surface of the sea 220. The spudcans 103 may be extracted from the seabed 122 and the support legs 102 may be raised to their upper most position so that the jackup rig 100 may return to its afloat configuration. The jackup rig 100 may then be relocated to a new site for further operations.

FIG. 3 illustrates the example mobile drilling platform of FIG. 2 from a top-down perspective. As illustrated, the jackup rig 100 has a triangle-shaped platform or deck 101 with three moveable support legs 102. The support legs 102 may be located at the corner-portions of the triangular-platform 101 to provide stability to the jackup rig 100 during operations. In contrast to FIGS. 1A-2, FIG. 3 illustrates the at least one preload tank 104 as multiple tanks rather than a single tank. In certain embodiments preload tank 104 may be a plurality of individual tanks that perform as preload tank 104 rather than a single tank. In embodiments where jackup rig 100 has more than one preload tank the combined total capacity of all of the preload tanks may be referred to as the volume capacity of preload tank 104. In some embodiments, the preload tanks may be integrated into the body of platform 101 of jackup rig 100. In certain embodiments, it may be possible to control the center of gravity of jackup rig 100 by controlling the distribution of water within the plurality of preload tanks.

Figure 4:
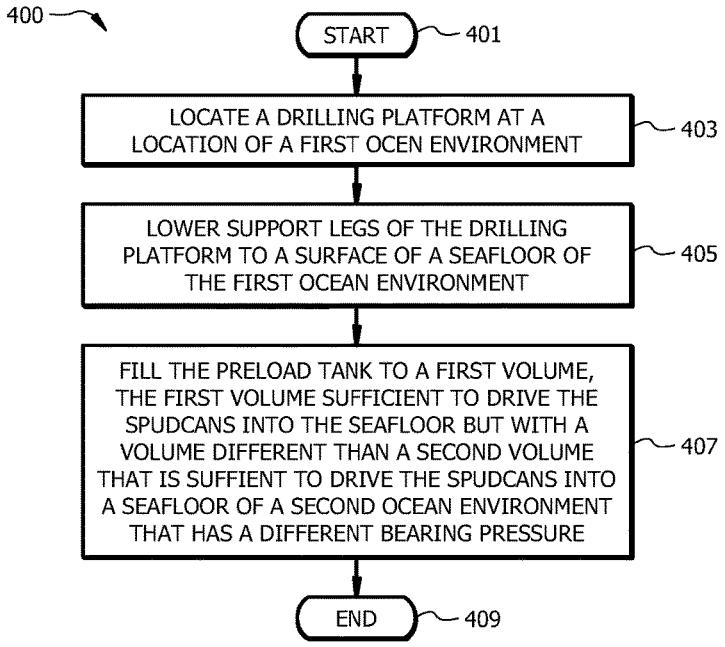
FIG. 4 is a flow chart illustrating a method of using the self-elevating vessel of FIG. 2 in an ocean environment.

FIG. 4 is a flowchart illustrating a method 400 of operating a multi-environment self-elevating vessel such as the jackup rig 100 illustrated in FIGS. 2-3. Method 400 may be initiated in step 401. Proceeding to step 403, the drilling platform may be located at a location of a first ocean environment. Next, in step 405 the support legs 102 of the drilling platform 100 may be lowered to the surface 121 of the seafloor of the first ocean environment.

In step 407 the at least one preload tank 104 may be filled to a first volume that is sufficient to drive the spudcans 103 at the bottom of the support legs 102 into the seafloor 121. The first volume in step 407 is a volume that is different than a second volume that is a volume sufficient to drive the spudcans into the seafloor 121 of another ocean environment that has a different bearing pressure requirement than the first ocean environment.

Method 400 may be concluded in step 409. In certain embodiments, method 400 may be repeated any number of times at the same or similar locations or may be relocated to another location having different environmental conditions. After relocating, method 400 may then be performed again. The method described with respect to FIG. 4 may have more or fewer steps, and the steps may be performed in any suitable order (e.g., steps 403-407 may performed as a single step or certain steps may be repeated or eliminated).

Figure 5:
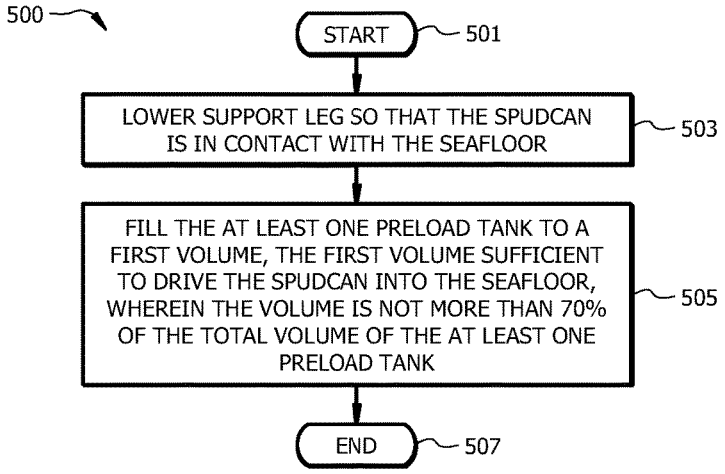
FIG. 5 is a flow chart illustrating a method of driving a spudcan into the seafloor of an ocean environment using a preload tank with reduced fill.

FIG. 5 is a flowchart illustrating a method 500 of driving a spudcan of a multi-environment self-elevating drilling platform such as the jackup rig 100 illustrated in FIGS. 2-3 into the seafloor of an ocean environment to secure the jackup rig 100. Method 500 may be initiated in step 501. Proceeding to step 503, the support leg 102 may be lowered such that the spudcan 103 affixed to the base of the support leg 102 is in contact with the seafloor 121. In step 505 the at least one preload tank 104 may be filled to a first volume sufficient to drive the spudcan 103 into the seafloor 121, where the first volume is not more than 70% of the volume capacity of the at least one preload tank 104.

Method 500 may be concluded in step 507. In certain embodiments, method 500 may be repeated any number of times at the same or similar locations or may be relocated to another location having different environmental conditions. After relocating, method 500 may then be performed again. The method described with respect to FIG. 5 may have more or fewer steps, and the steps may be performed in any suitable order (e.g., steps 503-505 may performed as a single step or certain steps may be repeated or eliminated).

Modifications, additions, or omissions may be made to any of the methods disclosed herein. These methods may include more, fewer, or other steps, and steps may be performed in parallel or in any suitable order. Certain examples have been described using the modifiers "first" or "second" (e.g., first ocean environment, second ocean environment; first volume, second volume). Unless the context in which these modifiers appear indicates otherwise, the modifiers do not require any particular sequence of steps or arrangement.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

The invention claimed is:

1. A self-elevating vessel comprising:

i. a hull consisting of:

at least one preload tank integrated into the hull;

(a) each preload tank configured to operate at a filled volume or at a reduced volume;

(b) each preload tank is sized to have a volume capacity based on multiple bearing pressures on a seabed for multiple ocean environments; and wherein (1) the at least one preload tank is filled to a first volume sufficient to drive all the spudcans into the seafloor in the first ocean environment having a first bearing pressure requirement; and (2) the at least one preload tank is filled to a second volume sufficient to drive all spudcans into the seafloor in the second ocean environment having a second bearing pressure requirement, and wherein the first volume is different than the second volume; and ii. a plurality of moveable support legs excluding the at least one preload tank each moveable support leg having a spudcan affixed to the moveable support leg at a position closest to a seafloor, each moveable support leg configured for an operating sequence:

(i) lowering to the seafloor;

(ii) extending into the seabed;

(iii) raising the hull containing the at least one preload tank;

wherein the hull and moveable legs create a dual classification according to a regulatory body for mode of operation for the self-elevating vessel, the self-elevating vessel configured to move from a first ocean environment with a first rating and a first bearing pressure requirement as pre-qualified self-elevating vessel for operation in a second ocean environment with a second rating and a second bearing pressure requirement which differs from the first ocean environment.

2. The self-elevating vessel of claim 1, wherein the footings are sized to achieve sufficient penetration into a seafloor based at least on the volume capacity of the at least one preload tank and the greater of the first bearing pressure requirement and the second bearing pressure requirement.

3. The self-elevating vessel of claim 1, wherein the first volume is a volume of preload fill that is less than is determined to cause any of the footings to punch through the seafloor of the first ocean environment.

4. The self-elevating vessel of claim 1, wherein the first volume is no more than seventy percent of the volume capacity.

5. The self-elevating vessel of claim 4, wherein the first volume is sixty percent of the volume capacity.

6. The self-elevating vessel of claim 1, wherein the footings do not have spudcan rings.

7. The self-elevating vessel of claim 1, wherein the footings are one of a spudcan affixed to a respective one of the plurality of legs and of a mat interconnecting the plurality of leg.

* * * * *